US007963056B1

(12) United States Patent
Mangone, Jr.

(10) Patent No.: US 7,963,056 B1
(45) Date of Patent: Jun. 21, 2011

(54) CABLE MARKERS FOR USE IN CLOSE QUARTERS

(76) Inventor: Peter G. Mangone, Jr., Golden, CO (US)

( * ) Notice: Subject to any disclaimer, the term of this patent is extended or adjusted under 35 U.S.C. 154(b) by 185 days.

(21) Appl. No.: 12/361,983

(22) Filed: Jan. 29, 2009

(51) Int. Cl.
*G09F 3/00* (2006.01)

(52) U.S. Cl. ..... 40/316; 24/459

(58) Field of Classification Search ..... 40/316; 24/453, 459; 248/73, 74.1
See application file for complete search history.

(56) References Cited

U.S. PATENT DOCUMENTS

| | | | | | |
|---|---|---|---|---|---|
| 1,703,609 | A | * | 2/1929 | Gastrow et al. | 40/316 |
| 4,234,090 | A | * | 11/1980 | Barbieri et al. | 206/459.5 |
| 4,649,658 | A | | 3/1987 | Sarton et al. | |
| 4,783,029 | A | * | 11/1988 | Geppert et al. | 248/74.1 |
| 4,876,810 | A | * | 10/1989 | Piana et al. | 40/316 |
| 5,115,586 | A | | 5/1992 | Hawker | |
| 5,189,766 | A | * | 3/1993 | Weber | 24/459 |
| 5,315,774 | A | * | 5/1994 | Chompff | 40/316 |
| 5,606,813 | A | | 3/1997 | Cornu et al. | |
| 5,890,635 | A | * | 4/1999 | Wu et al. | 224/148.4 |
| 5,896,826 | A | | 4/1999 | Winer | |
| 6,105,216 | A | * | 8/2000 | Opperthauser | 24/459 |
| 6,126,122 | A | * | 10/2000 | Ismert | 248/74.1 |
| 2004/0035029 | A1 | * | 2/2004 | Forsberg | 40/316 |

OTHER PUBLICATIONS

Color Coded Cable Markers, Wire Markers, Cable Wire Marker, Wire Marking S . . . ; RCCN Color Coded Cable Marker; published on internet web site: http://www.rc-cable.com/e4/e4-2/0201-2.html (Oct. 28, 2008).

Snap-Lock Cable IDs—CM001—Shop now—Black Box; Numerical Markers, 100-Pack; published on internet web site: http://www.blackbox.com/Store/Detail.aspx/Numerical-Markers-100-Pack/CM001 (Oct. 30, 2008).

Prepmain; Oval-Grip Permanent Wire Identification; published on internet web site: http://www.cablemarkers.com/prepmain.htm (Oct. 27, 2008).

ECOP Cable :: Homepage; ECOP Cable identification specialist; published on internet web site: http://ecopcable.com/index.htm (Oct. 30, 2008).

ECOP Cable :: Our Products :: Slip Loc Marker; ECOP Cable identification specialist; published on internet web site: http://ecopcable.com/products_sliplocmarker.htm (Oct. 30, 2008).

Budco Cable Online : Slip Lock Marker—0; published on internet web site: http://www.budcocable.com/Detail/?ID=264 (Oct. 27, 2008).

Budco Cable Online : Slip Lock Marker Phone Marker Yellow 1"'"; published on internet web site: http://www.budcocable.com/Detail/?ID=844 (Oct. 27, 2008).

MHO85X5WE9—Zoomed Image—HellermannTyton; published on internet web site: http://www.hellermanntyton.us/zoomImage.aspx?Ion=MHO85X5WE9 (Oct. 30, 2008).

Shanghai Xinlong Plastic Manufacturing Co., Ltd; X & L; Cable Markers; published on internet web site: http://www.china-cabletie.com/english/productShow.asp?id=230 (Oct. 28, 2008).

Partex UK—The POZ10 Cable Marker and PKH-POL Carrier Strips; published on internet web site: http://www.partex.co.uk/poz.html (Oct. 28, 2008).

(Continued)

*Primary Examiner* — Gary C Hoge
(74) *Attorney, Agent, or Firm* — Drinker Biddle & Reath LLP

(57) ABSTRACT

A cable marker having a collar member with an opening and a pair of legs extending distally from the opening, guide and locking assemblies at the distal ends of the legs, and a base member with cavities for receiving the guide and locking assemblies and a face surface with indicia for identifying the cable.

19 Claims, 5 Drawing Sheets

OTHER PUBLICATIONS

Partex UK—Paginated Wire and Cable Markers; published on internet web site: http://www.partex.co.uk/paginated.html (Oct. 28, 2008).

Partex UK—The PCA Open Style Wire / Cable Marker; published on internet web site: http://www.partex.co.uk/pca.html (Oct. 28, 2008).

Partex UK—The PC Open Style Wire / Cable Marker; published on internet web site: http://www.partex.co.uk/pc.html (Oct. 28, 2008).

Partex UK—The PA Chevron Cut Wire Marker; published on internet web site: http://www.partex.co.uk/pa.html (Oct. 28, 2008).

* cited by examiner

CABLE MARKERS FOR USE IN CLOSE QUARTERS

FIELD OF THE INVENTION

This invention pertains generally to cable markers and, more particularly, to space-efficient, easy to use and highly durable cable markers can that be retrofitted over already in-place cables, including in very close quarters where necessary.

BACKGROUND OF THE INVENTION

In today's increasingly complex wired world it is often necessary to mark individual electrical cables, wires and other insulated and uninsulated electrical conductors (referred to below generally as "cables") when they are installed or thereafter so that repairmen can easily identify them to connect, replace or repair individual electrical cables. It is particularly challenging to apply markers to cables once they are already installed and even more challenging when markers must be applied to previously installed cables in very close quarters.

Simply downsizing traditional cable markers to enable them to be used in tight spaces unfortunately makes it difficult to ensure the necessary cable marker durability. The new cable markers of the present invention solve this dilemma of small size versus compromised durability. Furthermore, many current cable markers use hinging mechanisms that make them vulnerable to material fatigue and difficult to manipulate and apply in close quarters. The present cable markers, however, are space efficient, durable, inexpensive and, most importantly, they are very easy to manipulate and lock in place even in very close quarters.

The cable markers of the present invention may be used to identify cables connected to electrical and electronic apparatus of various types by applying individual markers carrying readily readable color coding or alpha-numeric indicia. These cable markers are designed to be snapped onto the cables and therefore can be used with previously installed cables. The present cable markers may be used in sets of two or more if desired, hold tightly after application and may be easily removed, if later necessary.

BRIEF SUMMARY OF THE INVENTION

An important embodiment of this invention comprises a cable marker having a collar member that attaches to a base member. The collar member has an opening for receiving the cable to be marked and a pair of distally extending legs. The opening may be semicircular, rectangular or triangular.

Guide and locking assemblies are located at the distal ends of the collar member legs. The guide and locking assemblies each include an outer locking and guide member and an inner guide member which facilitate the attachment of the collar member to the base member as well as their separation if later necessary. The outer locking and guide members each have a latch hook.

The base member has cavities for receiving the guide and locking assemblies as well as a face surface with indicia that are exposed when the cable marker is mounted on a cable. The access ports have catch members with surfaces for guiding the guide and locking assemblies into the cavities and for engaging the latch hooks of the outer locking end guide members. The inner guide members of the guide and locking assemblies have guide bevel surfaces which help lift the guide and locking assembly free of the base member when the collar is detached from the base.

BRIEF DESCRIPTION OF THE DRAWINGS

The features of this invention that are believed to be novel are set forth with particularity in the appended claims. The invention, together with its objects and advantages, may be best understood with reference to the following description, taken in conjunction with the following drawings, in which like reference numerals identify like elements in the figures, and in which:

DETAILED DESCRIPTION OF A PREFERRED EMBODIMENT OF THE INVENTION

Figure 1:
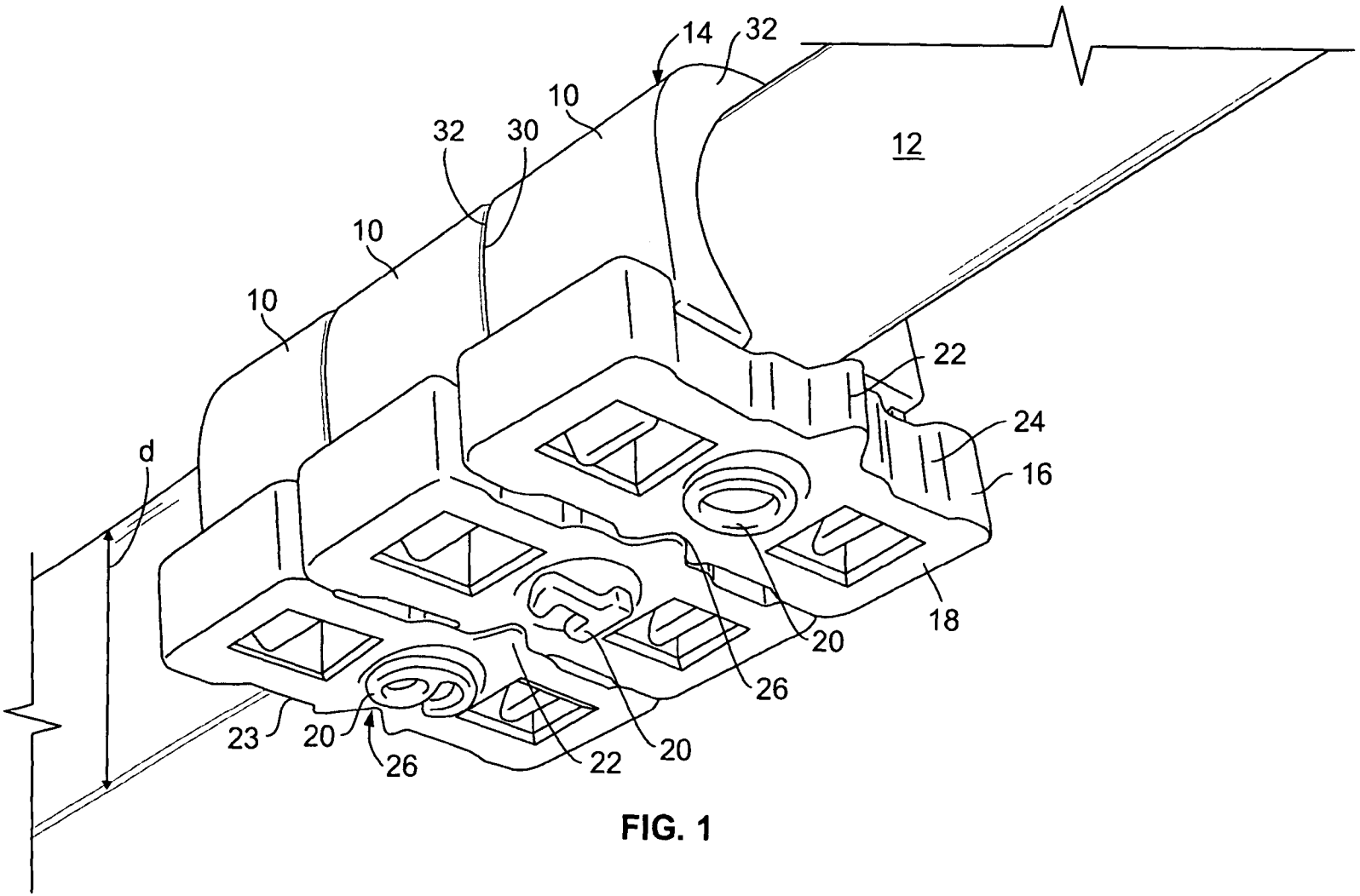
FIG. 1 is a perspective view showing three cable markers attached to a cable in close juxtaposition to each other.

Turning first to FIG. 1, a series of three cable markers 10 are shown mounted side-by-side on a cable 12 having a diameter "d". Preferably cable 12 will be generally circular in cross-section and between about ⅛ and ½ inch in diameter. Alternatively, the cable may be square or rectangular in cross section. The cable members preferably are molded out of a nylon, polyethylene or polypropylene resin.

Each of the cable markers comprises a "U" shaped collar member 14 interlocked with a base member 16. The base members have generally flat exposed face surfaces 18 carrying indicia 20 such as an alphanumeric symbols (e.g., the numbers "9," "1," and "0" seen in FIG. 1) formed in the exposed face surfaces as shown, or applied to the face surfaces by other known techniques. For example, the surface may be adapted for receiving indicia applied by the user. In certain applications the alphanumeric indicia may be dispensed with and the cable markers color-coded as desired. In other embodiments the cable markers may be both color-coded and/or marked with alphanumeric indicia.

Figure 3A:
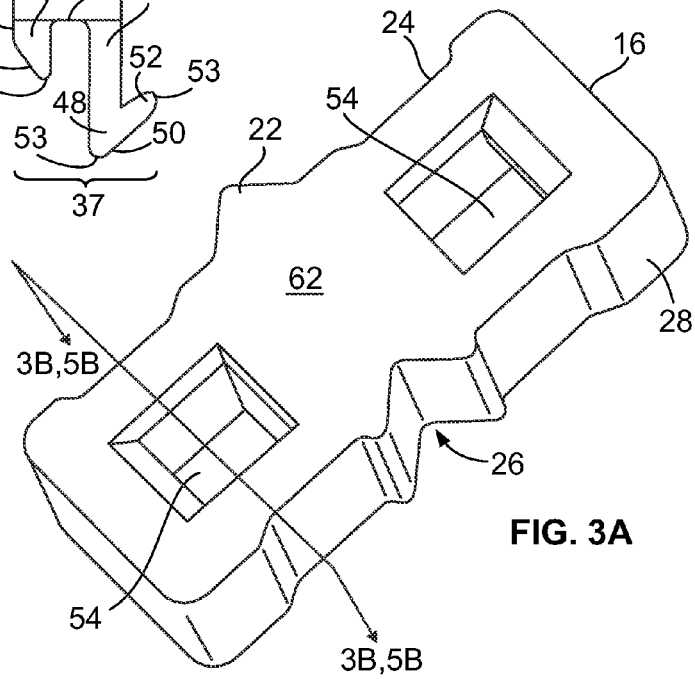
FIG. 3A is a perspective view of a base member of any one of the cable markers of FIG. 1.

Additionally, the base members may have protuberances 22 along a first lateral edge 24 that mate with correspondingly-shaped cavities 26 for receiving the protuberances of adjacent cable marker base members along the base member opposite lateral edge 28. For example, the protuberances and cavities may be of a triangular shape as illustrated in FIG. 3A. The mating protuberances and cavities cooperate with the first and second abutting lateral surfaces 30 and 32 of collar members 14 to maintain the alphanumeric indicia on face surfaces 13 close together in a readily perceived plane with abutting cable marker lateral surfaces 30 and 32 in tight juxtaposition.

Figure 2A:
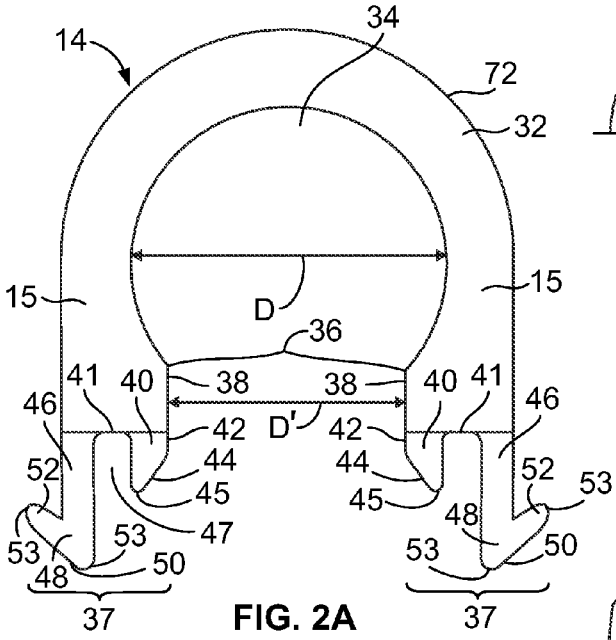
FIG. 2A is an elevation view of the collar member of any one of the cable markers of FIG. 1.

A "U" shaped collar member 14 in accordance with the present invention is illustrated in FIG. 2A. Collar member 14 thus includes distally extending legs 15 and an opening 34 that is generally semi-circular as shown and has a diameter "D" generally corresponding to diameter d (FIG. 1) of the cable 12 onto which the cable marker is intended to be placed. Preferably, diameter "D" should be equal to or up to about 10% less than the diameter d of the cable in order to insure that the collar remains in place on the cable while the base is positioned and attached to the collar. Also, if desired, protuberances and/or ridges may be placed on the inside of the collar to further minimize slippage.

Figure 2C:
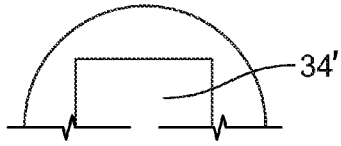
FIG. 2C is an enlarged view of a cable member with a generally rectangular opening.
Figure 2D:
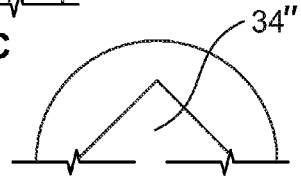
FIG. 2D is an enlarged view of a cable member with a generally triangular opening.
Figure 2B:
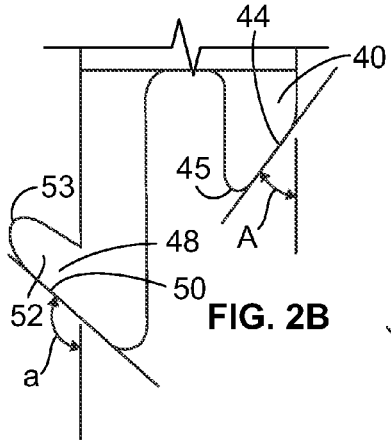
FIG. 2B is an enlarged view of a guide and locking assembly of the collar member of FIG. 2A.

When cable members do not have generally circular cross sections, opening 34 may be generally rectangular (opening 34' of FIG. 2C), generally triangular (opening 34" of FIG. 2D), or otherwise configured to accommodate the cable.

A generally rectangular passthrough 36 with generally parallel opposite sidewalls 38 spaced apart a distance D' opens into semi-circular opening 34. Distance D' preferably will be about 70% to 99% of the diameter d of the cable and about 72% of the cable diameter. The reduced spacing between opposite sidewalls 38 relative to the cable diameter opens legs 15 as the cable passes through passthrough 36. The cable then moves fully into opening 34 whereupon the collar member snaps onto and tightly engages the outer surface of the cable.

Collar member 14 also includes a pair of guide and locking assemblies 37 that project from the ledges 41 at the ends of the legs of the collar member. Each of the guide and locking assemblies includes an inner guide member 40 and an outer locking and guide member 46 at the distal ends of the legs.

Inner guide members 40 each have a generally flat inner surface 42 that is generally coplanar with sidewalls 38. Inner surface 42 turns outwardly at guide bevel surface 44 which continues to a preferably rounded proximal end 45 of the inner guide member to protect the guide member from damage when the collar is attached to the base. The angle "A" of bevel 44 preferably will be acute, more preferably will be from about 30 to 45 degrees and most preferably will be about 37 degrees relative to surface 42.

The inner guide members and outer guide and locking members are generally parallel to each other with an undercut area 47 between them that insures that member 46 will be able to flex inwardly when needed. Guide and locking members 46 have latch hooks 48 at their distal ends with distal outer bevel surfaces 50 on angularly upwardly directed latch hook nose portions 52. The angle "a" of beveled surfaces 50 relative to the longitudinal axis of the guide and locking members 46 should be from about 120 to 140 degrees and preferably be about 130 degrees. The proximal tips 53 of the outer guide member may be rounded as shown to protect the tips from damage. Inner and outer guide and locking members 40 and 46 which together comprise guide and locking assemblies 37 provide unique functionality to cable markers 10 as described below.

Figure 3B:
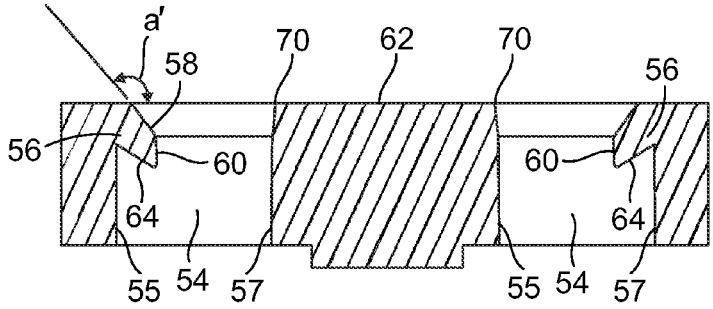
FIG. 3B is a cross section and view of the base member of FIG. 3A, taken along lines 3B-3B of FIG. 3A.

A base member 16 in accordance with the invention is illustrated in FIGS. 3A and 3B. The base member includes protuberance 22 on lateral edge 24 for mating with a corresponding cavity 26 on opposite lateral edge 28 of an adjacent base member when the cable markers are located in abutment on a cable as discussed above. The base member also includes a pair of preferably rectangular access ports 54 with first and second port sidewalls 55 and 57 for receiving guide and locking assemblies 37 of the collar member. Since the collar member is symmetrical, it may be attached to the base member without attention to which locking assembly enters which access port. However, the positioning of catch members 56 adjacent the entry of the access ports just below the upper surface 62 ensures that the collar and base can be locked together only in the proper orientation with the indicia-bearing face surface of the base member directed away from the collar and therefore fully visible.

As shown in FIG. 3B, each of the access ports has an inwardly protruding corner catch member 56 that cooperates with corresponding latch hooks 48 of the outer guide and locking members, as will be described below. Corner catch members 56 include downwardly angled top bevel surfaces 58 that meet generally flat inner surfaces 60. Surfaces 60 are oriented generally perpendicularly to upper surface 62 of the base member and parallel to sidewalls 55 at 57. Bevel surfaces 58 should be at an angle a' of from about 120 to 140 degrees and be about 130 degrees. Preferably angles a and a' will be about equal. The corner catch members additionally have bottom bevels 64 which preferably are at an angle less than a'.

The cable marker of the invention may be used as illustrated in FIGS. 4A-4D and described immediately below.

Attachment to Cable

Figure 4C:
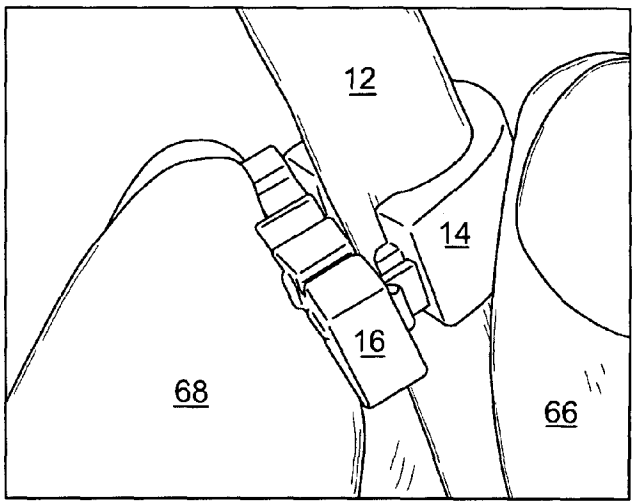
FIGS. 4A-4D illustrate the process of attachment of a cable marker in accordance with the present invention to a cable beginning with application of the collar to the cable in FIG. 4A through attachment of the base to the collar member in FIG. 4D.
Figure 4D:
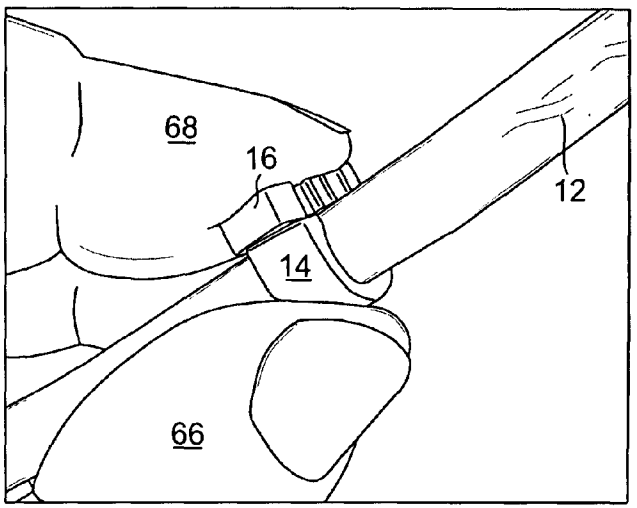
Figure 4A:
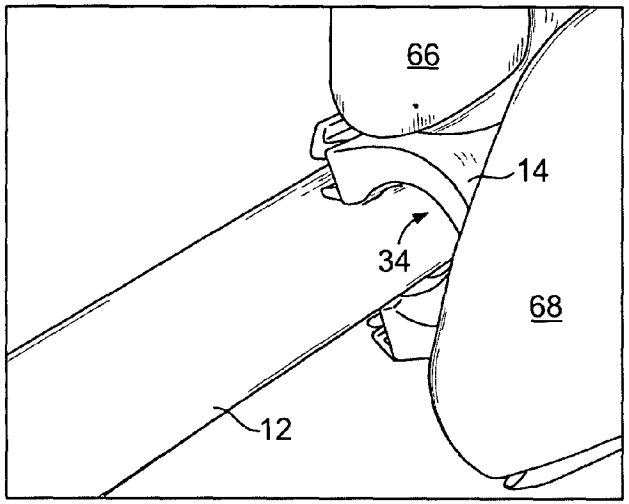
Figure 4B:
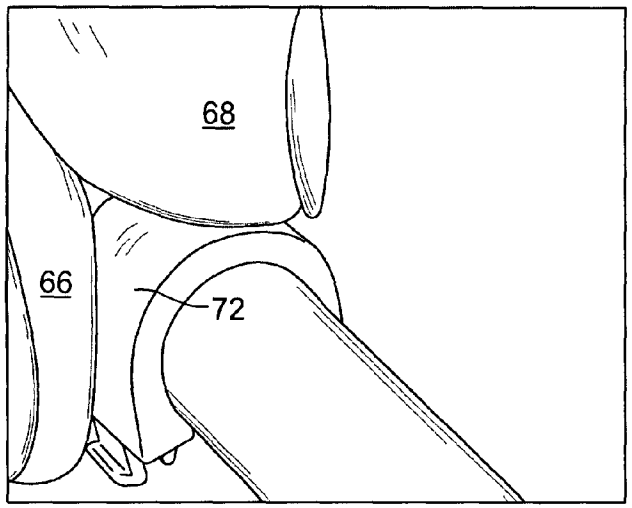

1. Collar member 14 is placed against the outer surface of cable 12 with bevels 44 (FIG. 2A) contacting the cable outer surface preferably with the user's thumb 66 and forefinger 68 abutting the collar member as shown in FIG. 4A. The collar member is then pressed downwardly, which causes the cable to move across passthrough 36 while flexing the collar member outwardly until the cable drops into semi-circular opening 34. Bevels 44 guide the sleeve over the cable upon installation and protect the guide and locking assembly from damage. Once in place, the collar member will resile inwardly and hold on the cable as shown in FIG. 4B.

2. Next, a base member 16 is placed under the collar member with guide and locking assemblies 37 aligned with respective access ports 54 and one or both of outer bevel surfaces 50 of latch hooks 48 abutting bevels 58 of the access ports. However, the positioning of catch members 56 in the access ports relative to the collar latch hooks ensures that the collar and base can be locked together only in the proper orientation with the indicia-bearing face surface of the base member directed away from the collar.

The collar member and base member are then pinched together. This typically will cause one of the locking collar member assemblies to first drop into its access port and then, with the application of continuing pinching force by the user, the second collar member assembly will move into its access port as the latch hooks flex inwardly to clear and engage catch members 56, as shown in FIG. 4C. Once both collar locking assemblies are in place in their respective access ports the cable marker will be locked onto the cable as depicted in FIG. 4D.

Figure 5A:
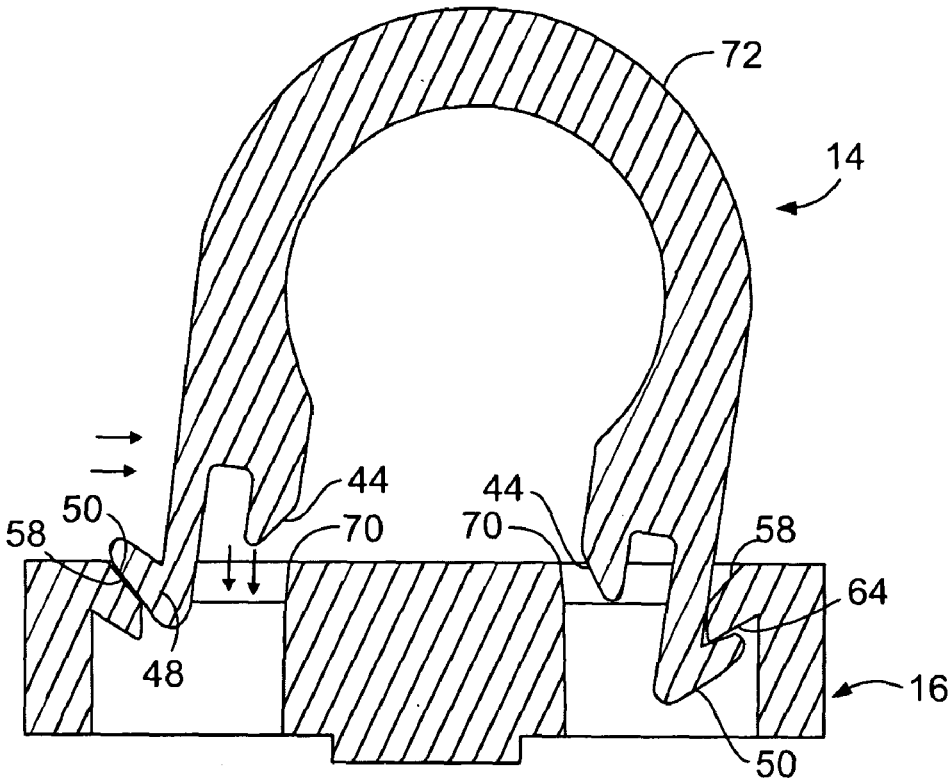
FIGS. 5A and 5B are cross-sectional views corresponding respectively to FIGS. 4A and 4D (with the cable removed for clarity) illustrating details of the attachment of the collar member to the base.
Figure 5B:
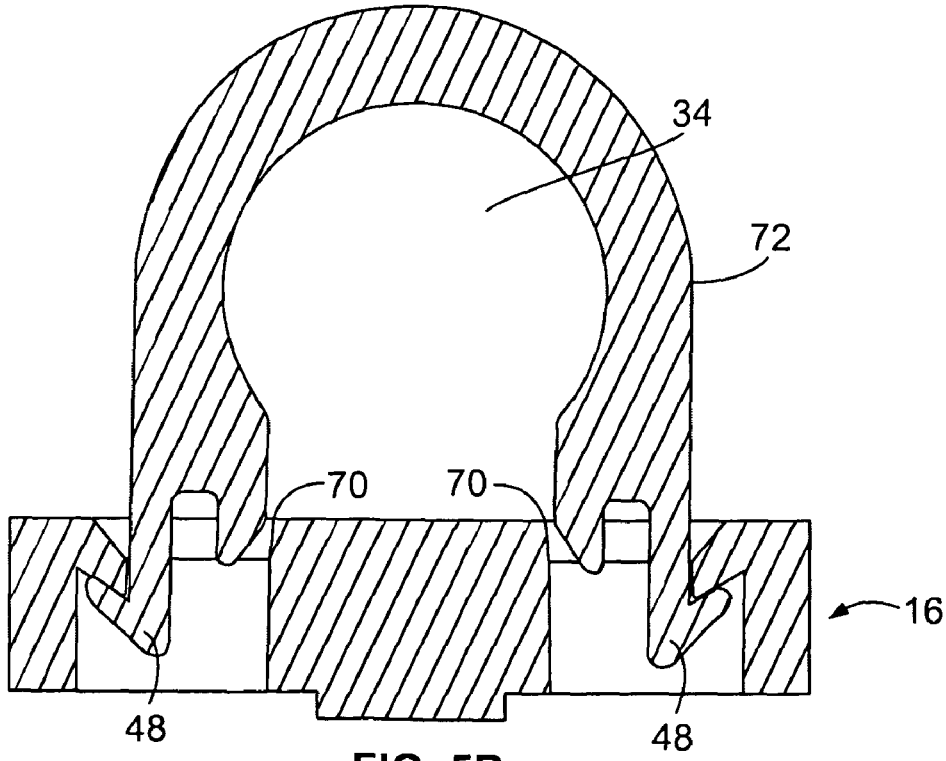

FIG. 5A is a cross sectional view of FIG. 4C which illustrates the final step in the attachment of the collar member to the base member. As can be seen in this Figure, outer bevel surface 50 of latch hook 48 at the left in the Figure initially abuts corresponding top bevel 58 of catch member 56. Meanwhile, the other latch hook 48 at the right in the Figure has entered access port 54 as the latch hook is pivotally held behind bottom bevel 64. Then, as the user continues to press down upon the collar, outer locking and guide member 46 will flex inwardly as bevel surface 50 moves downwardly along top bevel 58 of the catch member until the latch hook clears the catch member and springs back coming into position behind the catch member as shown in FIG. 5B. The contact and sliding motion between surfaces 50 and 58 distributes the force along the outer locking and guide members so that the hook is not damaged during the attachment process, while minimizing the danger of permanent deformation of the collar member which could adversely affect the reliability of the cable marker.

Removal

Figure 6:
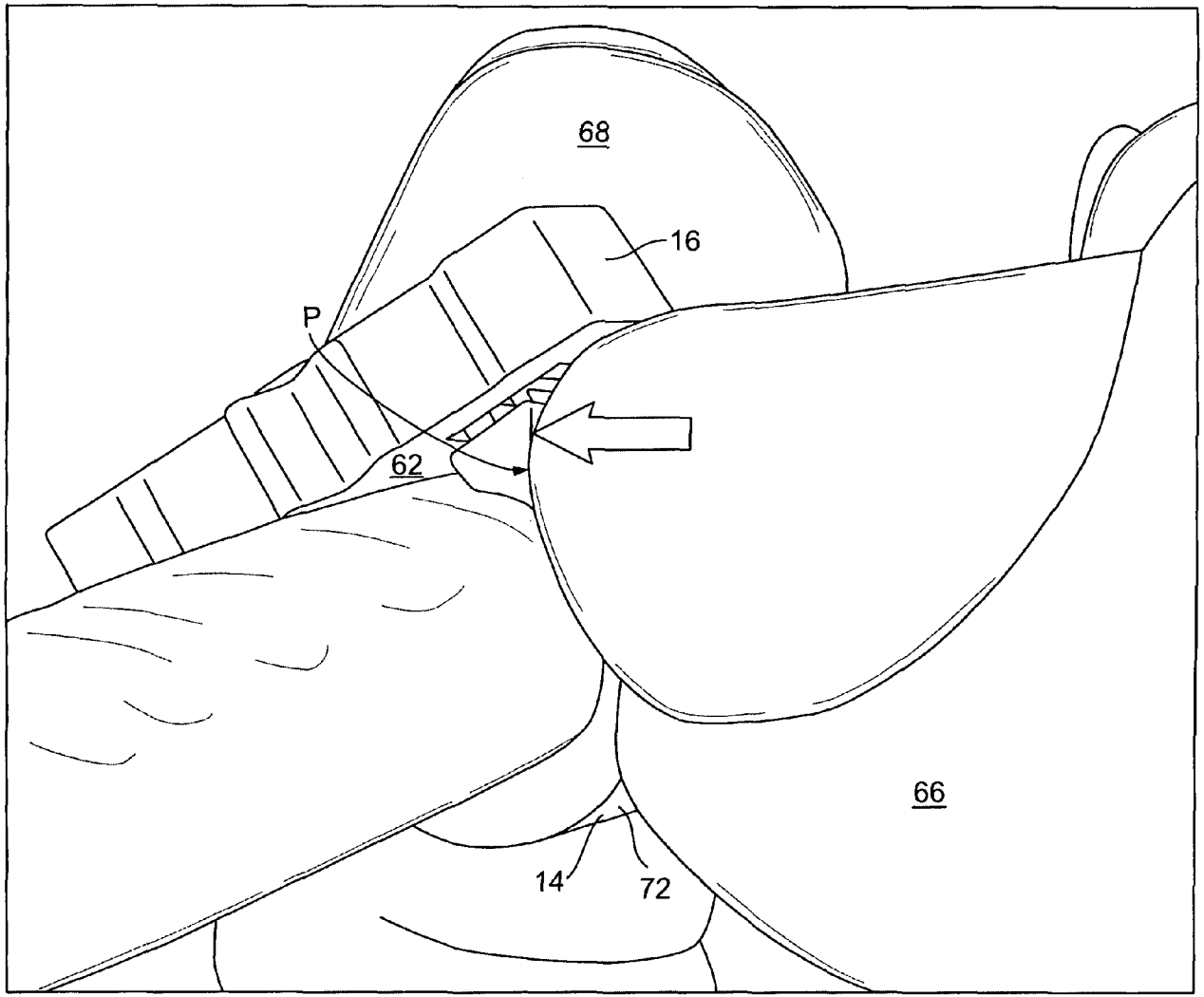
FIG. 6 illustrates the point of application of finger pressure to one leg of the collar member to remove the collar member from the base to enable the cable marker to be removed from the cable.

If it is desired to remove a previously installed cable marker, this can be easily done as illustrated in FIG. 6. As shown in this Figure, a user need merely pinch one side of the collar just above upper surface 62 of the base member (e.g., at point "P" on the outer surface 72 of the collar). This causes outer bevel surface 50 of latch hook 48 to slide downwardly along top bevel surface 58 of base member catch 56 until the latch hook clears the catch member 44. Meanwhile, guide bevel surface 44 of inner guide of locking member 40 rides up along inner edge 70 of cavity helping lift the guide and locking assembly free of the base member. When this happens, the base member easily pivots away from the collar so that the cable marker may be removed.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to collar both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A cable marker comprising:

collar member surrounding an opening and having a pair of distally extending legs;

guide and locking assemblies at the distal ends of the legs each including an outer locking and guide member and an inner guide member; and a base member with cavities for receiving the guide and locking assemblies and a face surface bearing or adapted to receive indicia, where the inner guide members and the outer locking and guide members are generally parallel to each other and have an undercut area between them that ensures that the outer locking and guide members will be able to flex inwardly.

2. The cable marker of claim 1 in which the opening is generally semicircular.

3. The cable marker of claim 1 in which the opening is generally rectangular.

4. The cable marker of claim 1 in which the opening is generally triangular.

5. The cable marker of claim 1 in which the opposite lateral edges of the base member have respective protuberances and cavities for mating with base members of adjacent cable markers.

6. The cable marker of claim 1 including a passthrough with generally parallel opposite sidewalls in communication with the opening.

7. The cable marker of claim 1 in which the outer locking and guide members each have a latch hook, and the cavities each have catch members for engaging the latch hooks.

8. The cable marker of claim 7 including outer bevel surfaces on the latch hooks angled at about 120 to 140 degrees relative to the longitudinal axis of the guide and locking members.

9. The cable marker of claim 8 in which the angle is about 130 degrees.

10. The cable marker of claim 1 in which each of the inner guide members has an inner surface and the inner surface turns outwardly to define a guide bevel surface having an acute angle relative to the inner surface.

11. The cable marker of claim 10 in which the angle is about 30 to 45 degrees.

12. The cable marker of claim 10 in which the angle is about 37 degrees.

13. The cable marker of claim 1 in which the indicia are alphanumeric symbols.

14. An indicia marked cable assembly comprising:

a cable;

a collar member surrounding an opening and having a pair of distally extending legs with the cable positioned within the opening;

guide and locking assemblies at the distal ends of the legs each including an outer locking and guide member and an inner guide member; and a base member with cavities for receiving the guide and locking assemblies and a face surface with indicia, where the inner wide members and the outer locking and guide members are generally parallel to each other and have an undercut area between them that ensures that the outer locking and guide members will be able to flex inwardly, the guide and locking assemblies being engaged in the cavities with the face surface directed away from the collar.

15. The assembly of claim 14 in which the opening is chosen from the group consisting of: generally semicircular, generally rectangular, and generally triangular.

16. The assembly of claim 14 in which the guide and locking assemblies each include an outer locking and guide member and an inner guide member, the outer locking and guide members each have a latch hook, and the cavities each have catch members engaging the latch hooks.

17. The assembly of claim 14 in which the cable has a circular cross-section and the collar includes a passthrough with generally parallel opposite sidewalls in communication with the opening, the opposite sidewalls being spaced apart a distance about 70% to 99% of the diameter of the cable.

18. The assembly of claim 14 in which both the cable and the opening have a circular cross-section and the diameter of the opening is equal to up to about 10% less than the diameter of the cable.

19. The assembly of claim 14 in which the indicia are alphanumeric symbols.

* * * * *